US012806539B2

(12) United States Patent
Yuan et al.

(10) Patent No.: US 12,806,539 B2
(45) Date of Patent: Nov. 24, 2026

(54) BALLOON COLUMN ASSEMBLY

(71) Applicant: Zhongshan ChangeMade Art & Craft Co., Ltd., Zhongshan (CN)

(72) Inventors: Mingxing Yuan, Zhongshan (CN); Huanhai Xin, Zhongshan (CN); Qinggang Yuan, Zhongshan (CN)

(73) Assignee: Zhongshan ChangeMade Art & Craft Co., Ltd., Zhongshan (CN)

( * ) Notice: Subject to any disclaimer, the term of this patent is extended or adjusted under 35 U.S.C. 154(b) by 0 days.

(21) Appl. No.: 19/302,521

(22) Filed: Aug. 18, 2025

(65) Prior Publication Data

US 2026/0115610 A1 Apr. 30, 2026

(30) Foreign Application Priority Data

Oct. 31, 2024 (CN) ..... 202422660337.7

(51) Int. Cl.
*A63H 27/10* (2006.01)

(52) U.S. Cl.
CPC ..... *A63H 27/10* (2013.01); *A63H 2027/1041* (2013.01)

(58) Field of Classification Search
CPC ..... A63H 27/10; A63H 2027/1008–1091
See application file for complete search history.

(56) References Cited

U.S. PATENT DOCUMENTS 2,664,667 A * 1/1954 Burroughs ..... A63H 27/10 446/222
2,840,948 A * 7/1958 Stickley ..... A63H 27/10 482/90
2,922,252 A * 1/1960 Van Dam et al. ..... A63H 27/10 446/221
3,366,999 A * 2/1968 Darby ..... B64B 1/58 24/570
3,892,081 A * 7/1975 Goral ..... G09F 21/06 116/63 P
4,068,119 A * 1/1978 Audet ..... F21V 21/06 362/410
4,145,838 A * 3/1979 Mason ..... A63H 27/10 446/225
4,229,784 A * 10/1980 Noguchi ..... F21S 6/005 362/361
4,462,065 A * 7/1984 Rhodes ..... F21V 21/32 362/396
4,527,225 A * 7/1985 Hartman ..... F21S 6/006 362/345
4,589,854 A * 5/1986 Smith ..... A63H 27/10 40/214
4,661,081 A * 4/1987 Basseches ..... A63H 27/10 446/222

(Continued)

*Primary Examiner* — Michael D Dennis
*Assistant Examiner* — Matthew B Stanczak
(74) *Attorney, Agent, or Firm* — Hemisphere Law, PLLC

(57) ABSTRACT

A balloon column assembly, including: a base plate, a support rod, and a balloon cup holder. The balloon cup holder is arranged with a first connecting member; an upper end of the support rod is arranged with a second connecting member threadedly connected to the first connecting member; the base plate is arranged with a third connecting member; and the support rod is arranged with a fourth connecting member threadedly connected to the third connecting member.

10 Claims, 4 Drawing Sheets

(56) References Cited

U.S. PATENT DOCUMENTS 4,715,841 A * 12/1987 Nelson ..... A63H 27/10 446/222
4,729,749 A * 3/1988 Milne ..... A63H 27/10 446/222
4,798,554 A * 1/1989 Nelson ..... A63H 27/10 446/222
4,895,545 A * 1/1990 Nelson ..... A63H 27/10 446/222
5,016,154 A * 5/1991 Leeyeh ..... F21V 21/10 362/431
5,142,464 A * 8/1992 Wang ..... F21S 6/007 362/411
D329,261 S * 9/1992 Pollack ..... D21/440
5,203,530 A * 4/1993 Liu ..... A63H 27/10 446/397
5,295,891 A * 3/1994 Schalk ..... F21V 3/023 446/485
D359,229 S * 6/1995 Jules ..... D8/395
D360,844 S * 8/1995 Miller ..... D10/110
5,444,607 A * 8/1995 Dreyfuss ..... F21V 3/023 362/157
5,649,764 A * 7/1997 Strickland ..... E04H 12/2238 362/431
5,800,052 A * 9/1998 Yeh ..... F21V 25/04 362/411
6,176,758 B1 * 1/2001 Wu ..... A63H 27/10 446/224
6,217,199 B1 * 4/2001 Lo ..... F21V 15/02 362/802
6,264,350 B1 * 7/2001 Swanson ..... F21V 21/06 362/410
6,375,534 B1 * 4/2002 Burns ..... A63H 27/10 40/212
6,969,295 B1 * 11/2005 Sidwell ..... A63H 27/10 446/220
D517,123 S * 3/2006 Sidwell ..... D8/42
7,588,477 B2 * 9/2009 Sidwell ..... A63H 27/10 446/224
RE41,056 E * 12/2009 Sidwell ..... D21/453
D628,659 S * 12/2010 Burns ..... D21/453
D659,200 S * 5/2012 Wicken ..... D21/440
D696,731 S * 12/2013 Nelson ..... D21/453
8,968,047 B1 * 3/2015 Wicken ..... F16M 13/02 248/346.03
9,011,195 B2 * 4/2015 Sidwell ..... G09F 21/06 446/224
9,314,706 B1 * 4/2016 Wicken ..... A63H 27/10
9,352,240 B1 * 5/2016 Wicken ..... A63H 27/10
9,399,176 B1 * 7/2016 Wicken ..... F16M 13/022
9,622,423 B1 * 4/2017 Rexford ..... A01G 5/04
9,679,504 B1 * 6/2017 Wicken ..... F16M 11/08
9,925,473 B2 * 3/2018 Povitz ..... A63H 27/10
9,957,707 B1 * 5/2018 Cooper, Jr. ..... F21S 4/20
D821,502 S * 6/2018 Mason ..... D21/453
D831,126 S * 10/2018 Goodman-Pollack ..... D21/453
10,231,557 B2 * 3/2019 Wilke ..... A47F 5/112
10,279,277 B2 * 5/2019 Nelson ..... A63H 27/10
10,661,189 B2 5/2020 Povitz
D934,350 S * 10/2021 Mason ..... D21/453
11,222,558 B2 * 1/2022 Wicken ..... G09F 15/0037
11,406,908 B2 8/2022 Clephan et al.
D1,010,015 S * 1/2024 Zhang ..... D21/453
D1,020,448 S * 4/2024 Gozeh ..... D8/394
12,163,767 B1 * 12/2024 Maiorano ..... F41J 1/10
D1,069,927 S * 4/2025 Mason ..... D21/453
2004/0027826 A1 * 2/2004 Walden ..... F21V 21/06 362/431
2006/0011793 A1 * 1/2006 Dupuis ..... H01Q 1/1207 248/205.5
2006/0246816 A1 * 11/2006 Sidwell ..... A63H 27/10 446/220
2006/0289707 A1 * 12/2006 Greenwald ..... A63H 27/10 248/127
2007/0049158 A1 * 3/2007 Chou ..... A63H 27/10 446/220
2007/0159836 A1 * 7/2007 Huang ..... F21S 8/086 362/411
2009/0251904 A1 * 10/2009 Cheng ..... F21S 6/007 362/414
2011/0218811 A1 * 9/2011 Li ..... A63H 27/10 704/E21.001
2012/0015581 A1 * 1/2012 Feldstein ..... A63H 27/10 446/71
2013/0163236 A1 * 6/2013 Steele ..... F21V 21/0824 362/418
2013/0322097 A1 * 12/2013 Schaak ..... F21S 6/007 362/414
2014/0248819 A1 * 9/2014 Nelson ..... A63H 27/10 446/220
2014/0352756 A1 * 12/2014 Lam ..... A63H 27/10 136/245
2015/0020859 A1 * 1/2015 Heining ..... E04H 15/36 135/124
2015/0165335 A1 * 6/2015 Hsiao ..... A63H 27/10 446/223
2015/0213742 A1 * 7/2015 Chapman-Rickman ..... A63H 27/10 446/221
2016/0214023 A1 * 7/2016 Wicken ..... A63H 27/10
2017/0144077 A1 * 5/2017 Wicken ..... A63H 27/10
2017/0319976 A1 * 11/2017 Nelson ..... A63H 27/10
2018/0059319 A1 * 3/2018 Carlyle ..... A63H 27/10
2018/0345160 A1 12/2018 Mullin
2019/0091594 A1 * 3/2019 Katz ..... A63H 27/10
2020/0009467 A1 * 1/2020 Clephan ..... A63H 27/10
2022/0223072 A1 * 7/2022 Wicken ..... G09F 19/008
2024/0181365 A1 * 6/2024 Josephs ..... F16L 41/03
2024/0375422 A1 * 11/2024 Drape ..... B65B 5/08
2024/0390812 A1 * 11/2024 Hawver ..... A63H 27/10
2025/0213996 A1 * 7/2025 Hung ..... A63H 27/10
2026/0115610 A1 * 4/2026 Yuan ..... A63H 27/10

* cited by examiner

BALLOON COLUMN ASSEMBLY

CROSS REFERENCE

The present application claims priority of Chinese Patent Application No. 202422660337.7, filed on Oct. 31, 2024, the entire contents of which are hereby incorporated by reference in its entirety.

TECHNICAL FIELD

The present disclosure relates to the technical field of decorative balloon installation, and more specifically to a balloon column assembly.

BACKGROUND

With the continuous expansion of the decorative balloon market, balloon columns are constantly being updated, but the following issues persist.

1. Currently, existing balloon columns are prone to detachment during installation and present cumbersome relocation.
2. Existing technologies typically employ insertion structures. Although convenient, their manufacturing processes are difficult to master. Even slight positive or negative tolerances result in widespread problems such as insecure connections or insertion difficulties among the base, support rod, and balloon cup holder.
3. Due to limited component universality in the existing products, packaging cannot achieve optimal solutions, which leads to high shipping costs, compromised portability, and suboptimal user experiences.

SUMMARY OF THE DISCLOSURE

A balloon column assembly, including: a base plate, a support rod, and a balloon cup holder; wherein the balloon cup holder is arranged with a first connecting member; an upper end of the support rod is arranged with a second connecting member threadedly connected to the first connecting member; the base plate is arranged with a third connecting member; and the support rod is arranged with a fourth connecting member threadedly connected to the third connecting member.

In some embodiments, the first connecting member is a screw rod fixed to a lower surface of the balloon cup holder, and the second connecting member is a first female thread component fixed to the upper end of the support rod and engaging with the screw rod.

In some embodiments, the support rod has a hollow structure, and a lower part of the first female thread component is inserted into an upper end opening of the support rod; the first female thread component is arranged with a limiting step that abuts against an upper end surface of the support rod.

In some embodiments, the fourth connecting member is a second female thread component fixed to a lower end of the support rod; the base plate is fixed with a nut; the third connecting member is a bolt that engages with the nut; an end of the bolt extends through the base plate and is threaded with the second female thread component.

In some embodiments, a front portion of the balloon cup holder is arranged with a first installation slot for installing a balloon; the first installation slot includes a transverse slot and a longitudinal slot; a front end of the longitudinal slot is disposed on an edge of the balloon cup holder and is an open end; a rear end of the longitudinal slot is in communication with the transverse slot; a middle portion of the balloon cup holder defines an elongated hole for installing the balloon.

In some embodiments, the rear end of the longitudinal slot is connected to a middle portion of the transverse slot to form the first installation slot in a T-shape, and the transverse slot is dumbbell-shaped, where both ends of the transverse slot each form a balloon-holding tab.

In some embodiments, a width of the longitudinal slot gradually decreases from the front end to the rear end of the longitudinal slot.

In some embodiments, a rear portion of the balloon cup holder is arranged with at least two second installation slots at intervals; rear ends of the at least two second installation slots are disposed on the edge of the balloon cup holder and are open ends, and front ends of the at least two second installation slots are closed ends; a ball-tying block is formed between each adjacent two second installation slots for securing the balloon.

In some embodiments, a width of the ball-tying block gradually increases from front to rear.

DETAILED DESCRIPTION

Figure 1:
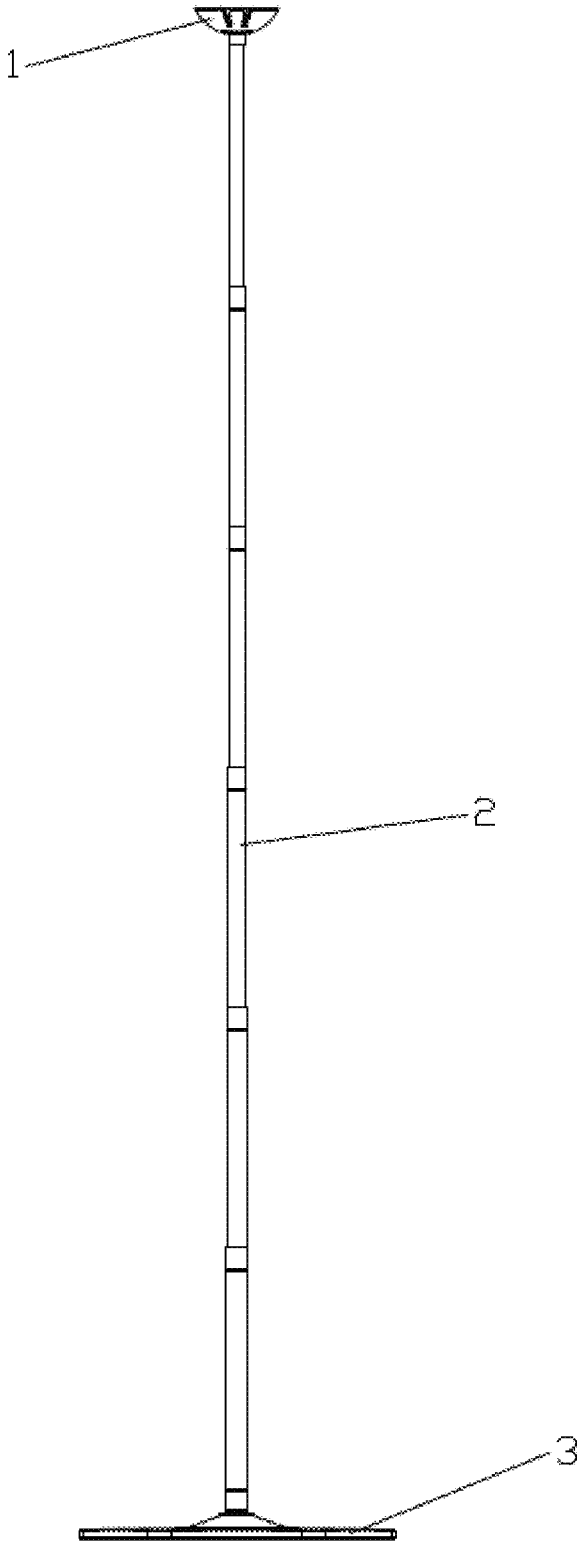
FIG. 1 is a front schematic view according to the present disclosure.
Figure 2:
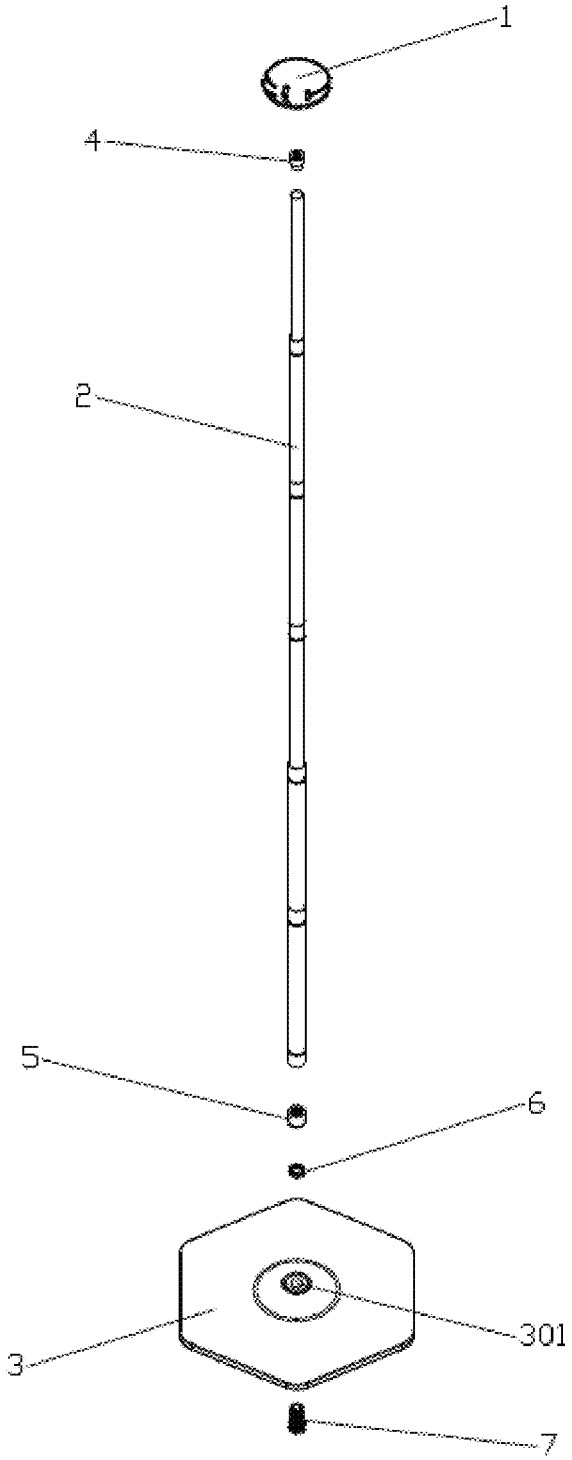
FIG. 2 is a disassembled schematic view according to the present disclosure.
Figure 3:
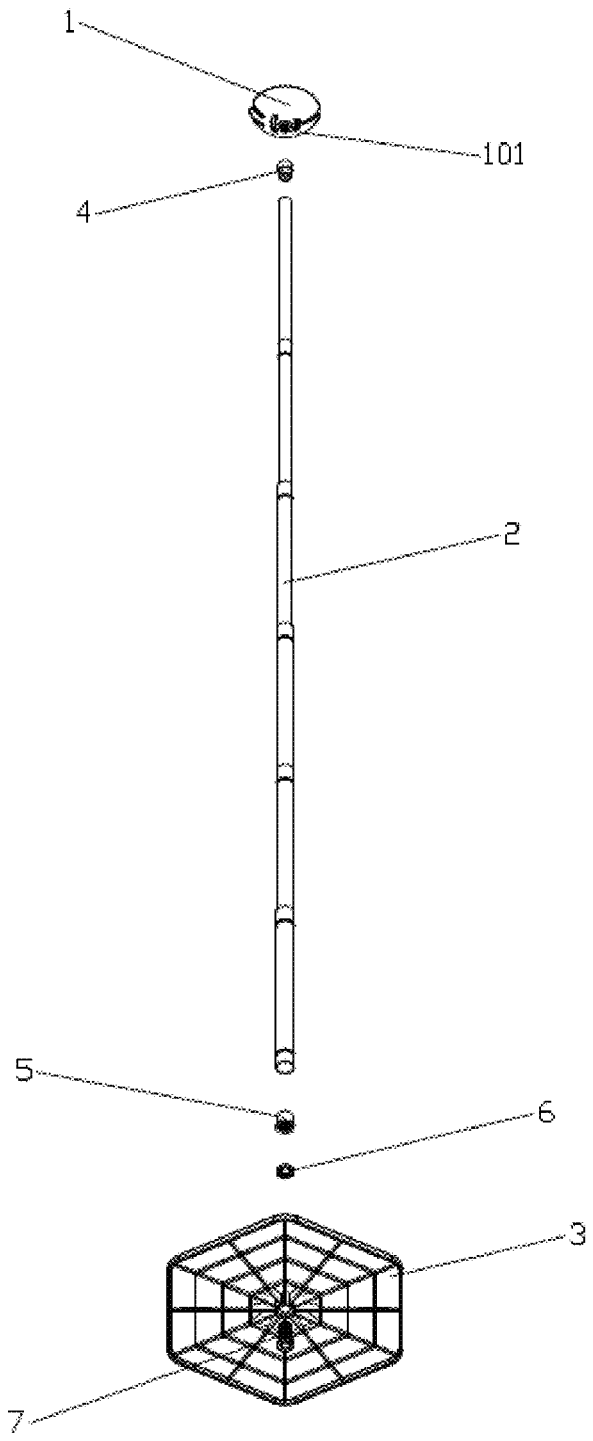
FIG. 3 is another disassembled schematic view according to the present disclosure.

The following description will provide a clear and complete explanation of the technical solution of the present disclosure with reference to the accompanying drawings.

It should be noted that all directional indications (such as up, down, left, right, front, rear, etc.) in the present disclosure are solely intended to explain the relative positions and movements of various components in a specific orientation (as shown in the accompanying drawings). When the specific orientation changes, the directional indications will also change accordingly.

Additionally, in the present disclosure, descriptions such as "preferred" and "second-preferred" are intended solely for descriptive purposes and should not be interpreted as indicating or implying relative importance or the number of technical features indicated. Therefore, features limited by "preferred" or "second-preferred" may explicitly or implicitly include at least one such feature.

Referring to FIGS. 1 to 5, the present disclosure provides a balloon column assembly, including a base plate 3, a support rod 2, and a balloon cup holder 1. The balloon cup holder 1 is arranged with a first connecting member. An upper end of the support rod 2 is arranged with a second connecting member threadedly connected to the first connecting member. The base plate 3 is arranged with a third connecting member. The support rod 2 is arranged with a fourth connecting member threadedly connected to the third connecting member. The balloon cup holder 1 is configured to install a balloon. The support rod 2 and the base plate 3, as well as the support rod 2 and the balloon cup holder 1, are connected in this manner, preventing the support rod 2 from separating from the base plate 3 and the support rod 2 from separating from the balloon cup holder 1, thereby ensuring that the balloon on the balloon cup holder 1 does not fall off due to the separation of the components of the balloon column assembly.

In some embodiments of the present disclosure, the first connecting member is a screw rod 101 fixed to a lower surface of the balloon cup holder 1, and the second connecting member is a first female thread component 4 fixed to the upper end of the support rod 2 and engaging with the screw rod 101. The support rod 2 has a hollow structure, and a lower part of the first female thread component 4 is inserted into an upper end opening of the support rod 2. The first female thread component 4 is fixed to the support rod 2 via riveting, welding, or screw connection. The first female thread component 4 is arranged with a limiting step that abuts against an upper end surface of the support rod 2. The fourth connecting member is a second female thread component 5 fixed to a lower end of the support rod 2. The base plate 3 is fixed with a nut 6, which may be fixed by the following method: during the injection molding of the base plate 3, the nut 6 is placed in the center of the mold cavity in advance, and the nut 6 and the base plate 3 are fixed simultaneously during the injection molding of the base plate 3. The third connecting member is a bolt 7 that engages with the nut 6. A middle of the base plate 3 defines a through hole 301, and an end of the bolt 7 extends through the through hole 301 on the base plate 3 and is threaded with the second female thread component 5.

In some embodiments, the first connecting member and the third connecting member may be replaced with nuts, and the second connecting member and the fourth connecting member may be replaced with threaded rods accordingly.

Figure 4:
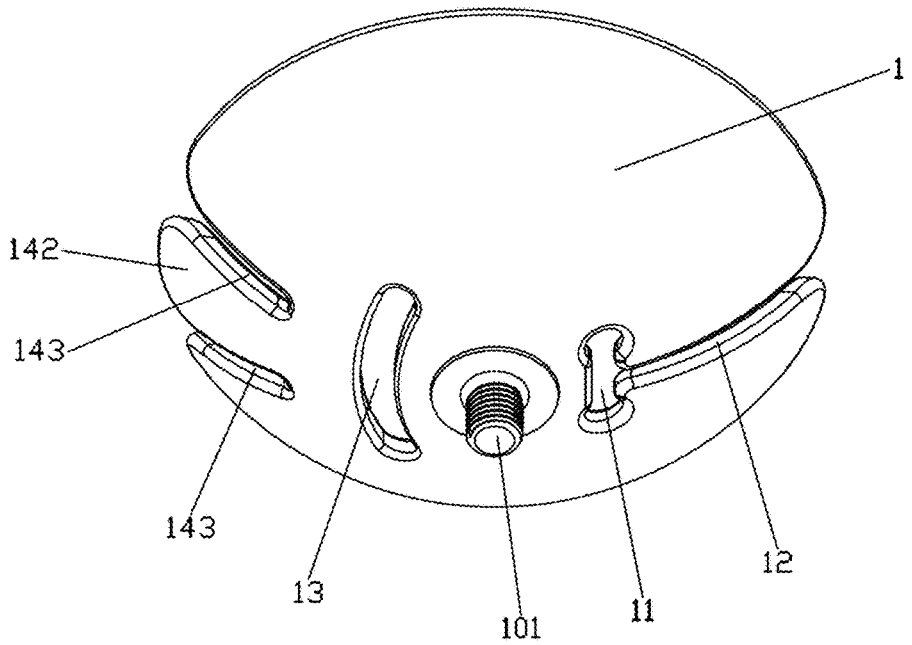
FIG. 4 is a perspective structural schematic view of a balloon cup holder according to the present disclosure.
Figure 5:
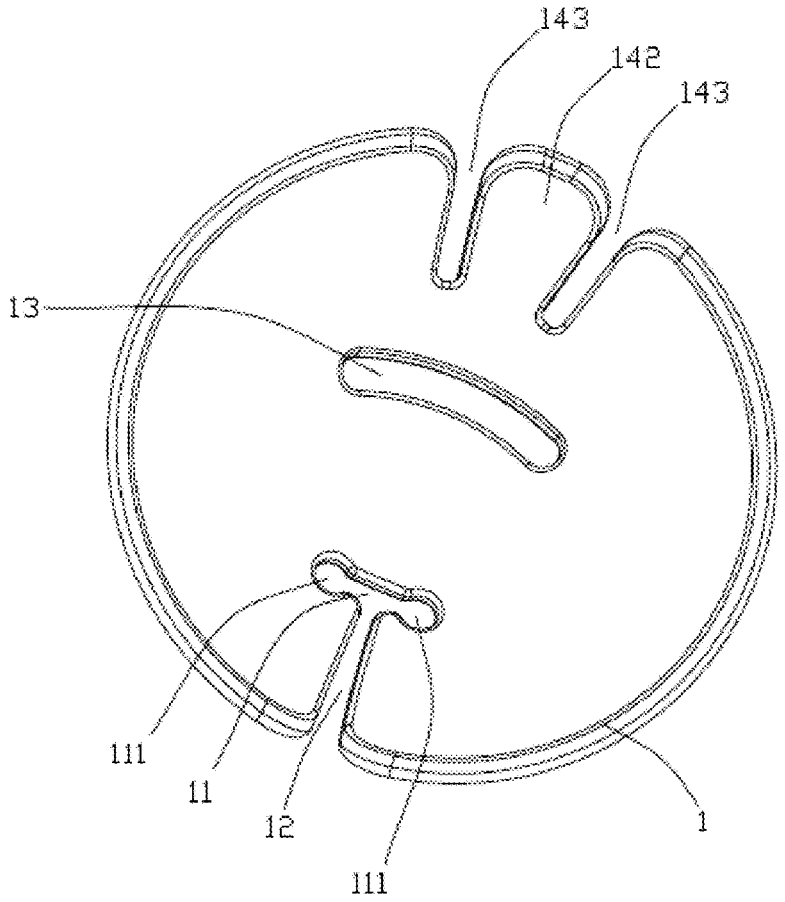
FIG. 5 is another perspective structural schematic view of a balloon cup holder according to the present disclosure.

Referring to FIGS. 4 and 5, the balloon cup holder 1 is a bowl-shaped housing. A front portion of the balloon cup holder 1 is arranged with a first installation slot for installing the balloon. The first installation slot includes a transverse slot 11 and a longitudinal slot 12. A front end of the longitudinal slot 12 is disposed on an edge of the balloon cup holder 1 and is an open end. A rear end of the longitudinal slot 12 is in communication with the transverse slot 11. A middle portion of the balloon cup holder 1 defines an elongated hole 13 for installing the balloon. In some embodiments, the rear end of the longitudinal slot 12 is connected to a middle portion of the transverse slot 11 to form the first installation slot in a T-shape, and the transverse slot 11 is shaped like a dumbbell such that both ends of the transverse slot 11 each form a balloon-holding opening 111. A rear portion of the balloon cup holder 1 is arranged with at least two second installation slots 143 at intervals. Rear ends of all the second installation slots 143 are disposed on the edge of the balloon cup holder 1 and are open ends, while front ends of all the second installation slots 143 are closed ends. A balloon-securing plate 142 is formed between each adjacent two second installation slots 143 for securing the balloon.

When securing a latex balloon, the balloon's head is first aligned with the balloon cup holder 1, and then the tail end of the balloon is inserted into the front end of the longitudinal slot 12 and guided along the longitudinal slot 12 and the transverse slot 11 into the balloon-holding openings 111 at both ends of the transverse slot 11. When the tail end of the balloon is longer, the tail end is pulled and secured at the closed ends of the second installation slots 143. When securing an aluminum mold balloon, the balloon's head is first aligned with the balloon cup holder 1, then tail end of the balloon is inserted from the inner wall of the balloon cup holder 1 via the elongated hole 13 to the exterior of the balloon cup holder 1, and then the tail end is pulled and secured at the closed ends of the second installation slots 143. The balloon cup holder 1 of the present disclosure is not only suitable for fixing latex balloons but also for fixing aluminum mold balloons. A single cup holder can accommodate two different types of balloons, making it more versatile and reducing waste.

The support rod may be a length-adjustable rod or an integral hollow rod.

In some embodiments, a width of the longitudinal slot 12 gradually decreases from the front end to the rear end of the longitudinal slot 12, while a width of the balloon-securing plate 142 gradually increases from front to rear.

The beneficial effects of the present disclosure are as follows: The support rod and the base plate, as well as the support rod and the balloon cup holder, are connected in this manner, preventing the support rod from separating from the base plate and the support rod from separating from the balloon cup holder, thereby ensuring that the balloon on the balloon cup holder does not fall off due to the separation of the components of the balloon column assembly.

The above description is merely some embodiments of the present disclosure and does not limit the scope of the present disclosure. Any equivalent structural modifications made under the disclosure concept of the present disclosure, or direct or indirect application in other related technical fields, are all included within the scope of the patent protection for the present disclosure.

What is claimed is:

1. A balloon column assembly, comprising: a base plate, a support rod, and a balloon cup holder; wherein the balloon cup holder is arranged with a first connecting member; an upper end of the support rod is arranged with a second connecting member threadedly connected to the first connecting member; the base plate is arranged with a third connecting member; and the support rod is arranged with a fourth connecting member threadedly connected to the third connecting member;

wherein the balloon cup holder is disk-shaped and defines a first installation slot, an elongated hole, and at least two second installation slots; the first installation slot and the at least two second installation slots are respectively arranged at two opposite sides of a diameter of the balloon cup holder, and the elongated hole is arranged between the first installation slot and each of the at least two second installation slots; the first installation slot and the elongated hole are dimensioned and positioned relative to the at least two second installation slots such that the first installation slot and the elongated hole are respectively structurally adapted to cooperate with different ones of the second installation slots to secure a first type of balloon and a second type of balloon respectively;

wherein a front portion of the balloon cup holder is defined with the first installation slot; the first installation slot comprises a transverse slot and a longitudinal slot; a front end of the longitudinal slot is disposed on an edge of the balloon cup holder and is an open end; a rear end of the longitudinal slot is in communication with the transverse slot; a middle portion of the balloon cup holder defines the elongated hole.

2. The balloon column assembly according to claim 1, wherein the first connecting member is a screw rod fixed to a lower surface of the balloon cup holder, and the second connecting member is a first female thread component fixed to the upper end of the support rod and engaging with the screw rod.

3. The balloon column assembly according to claim 2, wherein the support rod has a hollow structure, and a lower part of the first female thread component is inserted into an upper end opening of the support rod; the first female thread component is defined with a limiting step that abuts against an upper end surface of the support rod.

4. The balloon column assembly according to claim 1, wherein the fourth connecting member is a second female thread component fixed to a lower end of the support rod; the base plate is fixed with a nut; the third connecting member is a bolt that engages with the nut; an end of the bolt extends through the base plate and is threaded with the second female thread component.

5. The balloon column assembly according to claim 1, wherein the rear end of the longitudinal slot is connected to a middle portion of the transverse slot to form the first installation slot in a T-shape, and the transverse slot is dumbbell-shaped, and both ends of the transverse slot each form a balloon-holding opening.

6. The balloon column assembly according to claim 5, wherein each of the balloon-holding openings formed at both ends of the transverse slot is configured to secure a latex balloon.

7. The balloon column assembly according to claim 1, wherein a width of the longitudinal slot decreases from the front end to the rear end of the longitudinal slot.

8. The balloon column assembly according to claim 1, wherein a rear portion of the balloon cup holder is arranged with the at least two second installation slots at intervals; rear ends of the at least two second installation slots are disposed on the edge of the balloon cup holder and are open ends, and front ends of the at least two second installation slots are closed ends; a balloon-securing plate is formed between each adjacent two second installation slots.

9. The balloon column assembly according to claim 8, wherein a width of the balloon-securing plate increases from front to rear.

10. The balloon column assembly according to claim 1, wherein a length direction of the longitudinal slot and length directions of the at least two second installation slots are perpendicular to a length direction of the transverse slot and a length direction of the elongated hole; the length direction of the transverse slot is parallel to the length direction of the elongated hole.

* * * * *